US007252473B2

(12) United States Patent
Bailey

(10) Patent No.: US 7,252,473 B2
(45) **Date of Patent: *Aug. 7, 2007**

(54) WOOD CHIP FLINGER AND METHOD OF DENSELY PACKING WOOD CHIPS WITH LARGE ANGLE OUTPUT

(75) Inventor: Kenneth F. Bailey, Apex, NC (US)

(73) Assignee: Bailey Consulting, Inc., Apex, NC (US)

( * ) Notice: Subject to any disclaimer, the term of this patent is extended or adjusted under 35 U.S.C. 154(b) by 434 days.

This patent is subject to a terminal disclaimer.

(21) Appl. No.: 10/678,838

(22) Filed: Oct. 3, 2003

(65) Prior Publication Data

US 2004/0065386 A1 Apr. 8, 2004

Related U.S. Application Data

(63) Continuation-in-part of application No. 10/241,725, filed on Sep. 11, 2002, now Pat. No. 6,811,020, and a continuation-in-part of application No. 10/465,182, filed on Jun. 19, 2003, now abandoned.

(51) Int. Cl.
*B65G 65/30* (2006.01)

(52) U.S. Cl. ..... 414/339; 414/301; 198/642

(58) Field of Classification Search ..... 414/293, 414/301, 439, 332, 339; 198/642; 236/664; 239/679, 676; 241/297
See application file for complete search history.

(56) References Cited

U.S. PATENT DOCUMENTS

| | | | | |
|---|---|---|---|---|
| 1,691,683 | A | 11/1928 | Townsend | |
| 2,239,448 | A * | 4/1941 | Selhorst | 241/273.3 |
| 2,788,115 | A * | 4/1957 | Friedman | 414/301 |
| 2,845,190 | A | 7/1958 | Creuzburg | |
| 2,970,782 | A | 2/1961 | Fleissner | |
| 3,191,783 | A | 6/1965 | Henderson | |
| 3,643,819 | A | 2/1972 | Halcomb | |
| 4,479,428 | A | 10/1984 | Krueger et al. | |
| 4,820,108 | A | 4/1989 | Kneer | |
| 5,184,714 | A | 2/1993 | Tapp | |
| 5,316,429 | A | 5/1994 | Connelly et al. | |
| 5,348,434 | A | 9/1994 | Peeples et al. | |
| 5,393,189 | A | 2/1995 | Berquist | |

(Continued)

FOREIGN PATENT DOCUMENTS

| | | |
|---|---|---|
| GB | 2173682 | * 10/1986 |

*Primary Examiner*—Charles A. Fox
(74) *Attorney, Agent, or Firm*—Coats & Bennett, P.L.L.C.

(57) ABSTRACT

A handling device packs wood chips with a density greater than that achieved using conventional free-fall techniques by ≧20%-35%. The device includes a drum rotating about a generally horizontal axis that includes a plurality of outwardly extending blades that act to fling the wood chips so as to land with a substantially uniform orientation. The blades may comprise a leading face with at least a first face section that extends in a first direction and at least a second face section extending at a forward angle relative to the first section. The first direction may be generally normal to the drum core's peripheral surface. The output from the drum, when an input stream of wood chips is fed to the drum, covers an arc of at least 90°, typically in the range of 90°-120° and generally downwardly facing, when viewed from the side along the axis.

38 Claims, 6 Drawing Sheets

U.S. PATENT DOCUMENTS 5,735,319 A 4/1998 McNamara et al.
6,948,610 B2 * 9/2005 Connor et al. ..... 198/642

2002/0076308 A1 6/2002 Bailey et al.

* cited by examiner

WOOD CHIP FLINGER AND METHOD OF DENSELY PACKING WOOD CHIPS WITH LARGE ANGLE OUTPUT

This application is a continuation-in-part application of U.S. patent application Ser. No. 10/241,725, filed Sep. 11, 2002, now U.S. Pat. No. 6,811,020, and a continuation-in-part of U.S. patent application Ser. No. 10/465,182, filed Jun. 19, 2003, now abandoned, the disclosures of which are incorporated herein by reference.

BACKGROUND OF THE INVENTION

The present invention relates generally to the field of wood chip processing, and more particularly to a machine and associated method for dense packing of wood chips for storage, transport, or further processing.

One major factor in the cost of wood chips for paper making is the cost of transporting the wood chips from the chip manufacturing site to the paper mill. The wood chips are typically transported in rail cars, but may also be transported in barges, trailers, or the like. Typically, the transportation costs are based primarily on the number of containers used to ship a given load of wood chips. As more densely packed containers means that fewer containers are required to ship a given amount of wood chips, it follows that more densely packed containers will generally supply more useable wood chips to the paper mill at a lower transportation cost.

Space considerations are also relevant in the storage and processing of wood chips. For instance, the storage of wood chips on site, such as at a pulp mill, consumes space. As such, it is advantageous to have the wood chips densely packed when "stacking" the wood chips for storage. Similarly, many methods of processing wood chips include batch processing steps that take place in pressure vessels, or other containers, that have fixed volumes. If additional wood chip materials can be packed into the containers, the batch process can likely be made more efficient.

Even with these considerations, many wood chip transporting, storing, and/or processing approaches rely on either conventional free-fall techniques or on techniques that result in packing densities of typically not more than 17% improvement over free-fall techniques.

Accordingly, there remains a substantial need in the industry for alternate wood chip handling techniques that allow for higher packing densities.

SUMMARY OF THE INVENTION

A wood chip handling device of the present invention allows wood chips to be packed (or, synonymously "stacked") with a density greater than that achieved using conventional free-fall techniques. Preferably, the device packs the wood chips at a density that is at least 20% more than that achieved with the conventional free-fall techniques.

In one embodiment, the wood chip handling device includes a drum disposed so as to rotate about a generally horizontal axis and spinning at a rate of about 50 rpm or more, and advantageously 150 rpm or more. The rotating drum includes a plurality of outwardly extending blades. The blades may have a leading face with at least a first face section that extends in a first direction and at least a second face section extending at a forward angle relative to the first face section. For example, the blades may have a leading face with a first face section that extends from a peripheral surface of the drum in a direction generally normal to the peripheral surface and a second face section disposed more outward from the axis than the first face section, the second face section extending at a forward angle relative to the first section. The first and second face sections may be generally planar, and are preferably, but not necessarily, contiguous. The output from the drum, when an input stream of wood chips is fed to the drum, covers an arc of at least 90°, typically in the range of 90°-120° and generally downwardly facing, when viewed from a position along the horizontal axis spaced away from the drum. The device may further include a motor operatively connected to the drum and supplying rotational power thereto, a feed chute disposed upstream from the drum and supplying the input stream of wood chips to the drum, and/or a container for receiving the output. The feed chute may include a baseplate and a plurality of divider walls moveably mounted to the baseplate, wherein the divider walls control the relative flow ratios of the input stream to a first side portion, a center portion, and a second side portion of the drum. As indicated above, the output stream from the device advantageously causes a pile of wood chips to be formed a packing density factor of at least 1.20, or at least 1.25 in some embodiments. The pile may be in a container, e.g., a railcar or barge, or may be on the ground or other open surface.

DESCRIPTION OF THE PREFERRED EMBODIMENTS

Figure 1:
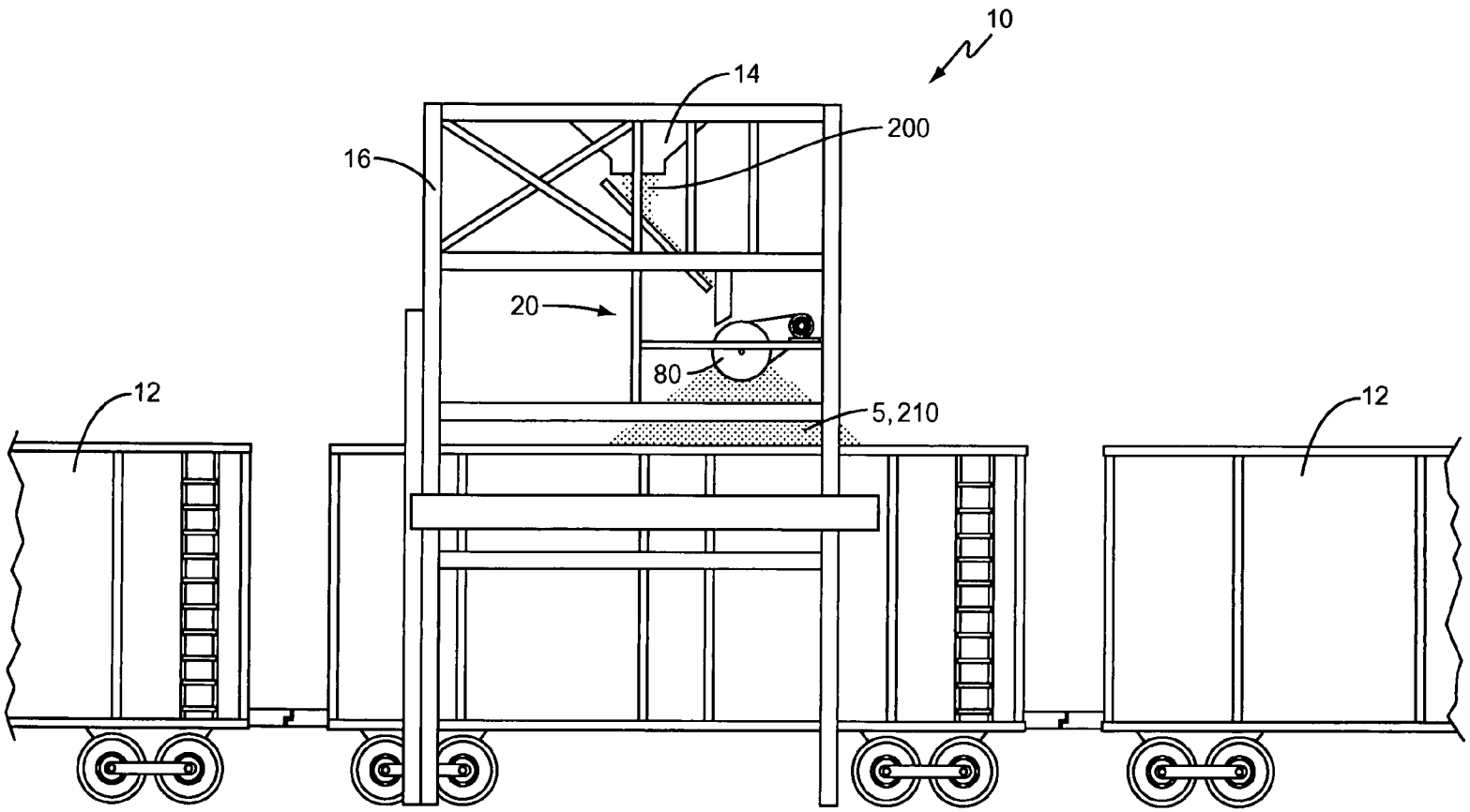
FIG. 1 shows one embodiment of the device of the present invention employed in a wood chip loading station for filling railcars.

In order to provide a better understanding of the present invention, one embodiment of the wood chip handling device according to the present invention is shown in FIG. 1 in the context of a wood chip loading station 10 for filling railcars 12. The wood chip handling device, generally indicated at 20, is shown installed in a tower structure 16 that extends above a rail line with a railcar 12 thereon. Wood chips 5 are fed to the handling device 20 in the tower 16 by any suitable means, such as by conventional conveyor system 14 (only the output funnel of which is shown for clarity), or alternatively via a pneumatic means into a cyclone, or by other like means known in the art. While the input feed system (e.g., conveyor system 14) is shown with only one output, it should be understood that the input feed system may have multiple outputs, such as in a so-called "pants leg" inverted "Y" system known in the art, advantageously with a handling device 20 at each output. The handling device 20 takes the input stream of wood chips from the conveyor 14 and directs it into the railcar 12 so that the wood chips 5 are relatively densely packed in the railcar 12. In most applications, the railcar 12 will be moved underneath the handling device 20 during the loading process so as to fill the entirety of the railcar's length, but the device 20 (with or without the tower 16) may alternatively be moved while the railcar 12 is held stationary, if desired.

Figure 2:
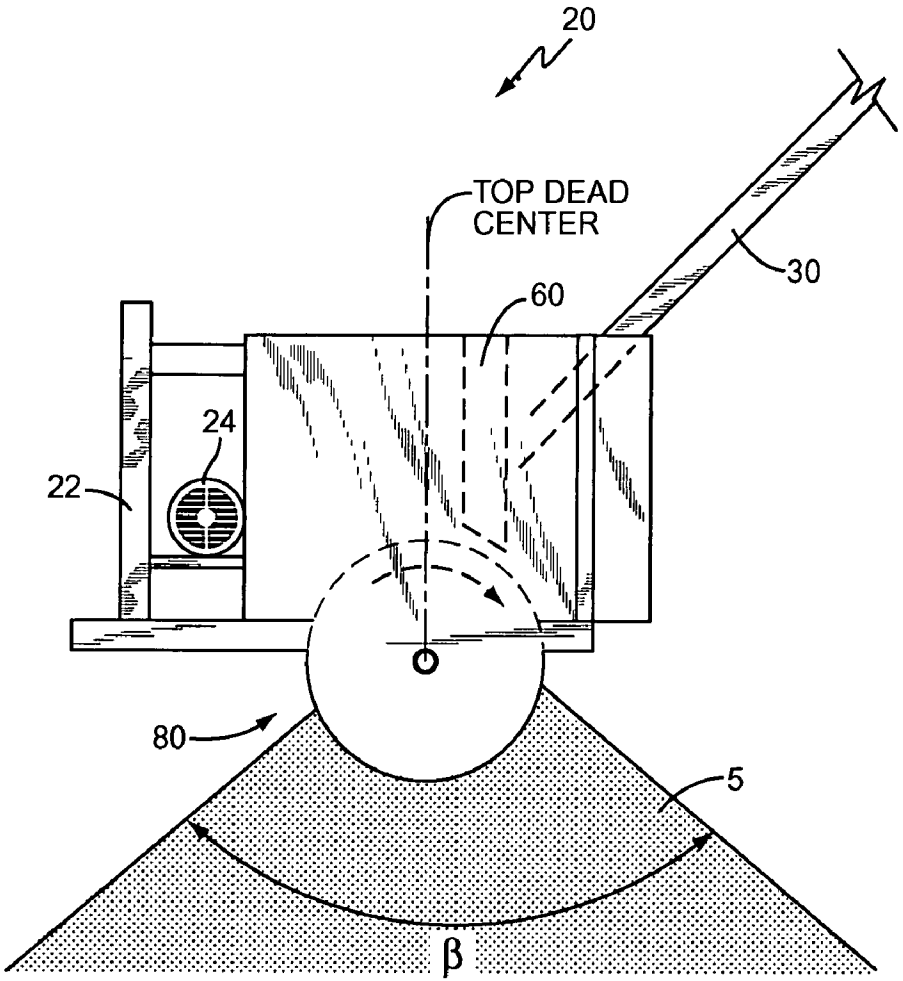
FIG. 2 shows a side view of one embodiment of the device of the present invention.

One embodiment of the handling device 20, sometimes referred to herein as the "flinger," includes a frame 22, a motor 24, a feed chute assembly 30, and a drum 80. See FIG. 2. The frame 22 supports the motor 24, feed chute assembly 30, and drum 80, and may take any suitable form known in the art, such as welded assembly of angle iron. The motor 24 supplies rotational power to the drum 80, typically via a pulley and belt arrangement (not shown in detail). The motor 24 may be of any type known in the art, but is typically an electric motor of approximately fifteen horsepower or more.

Figure 3:
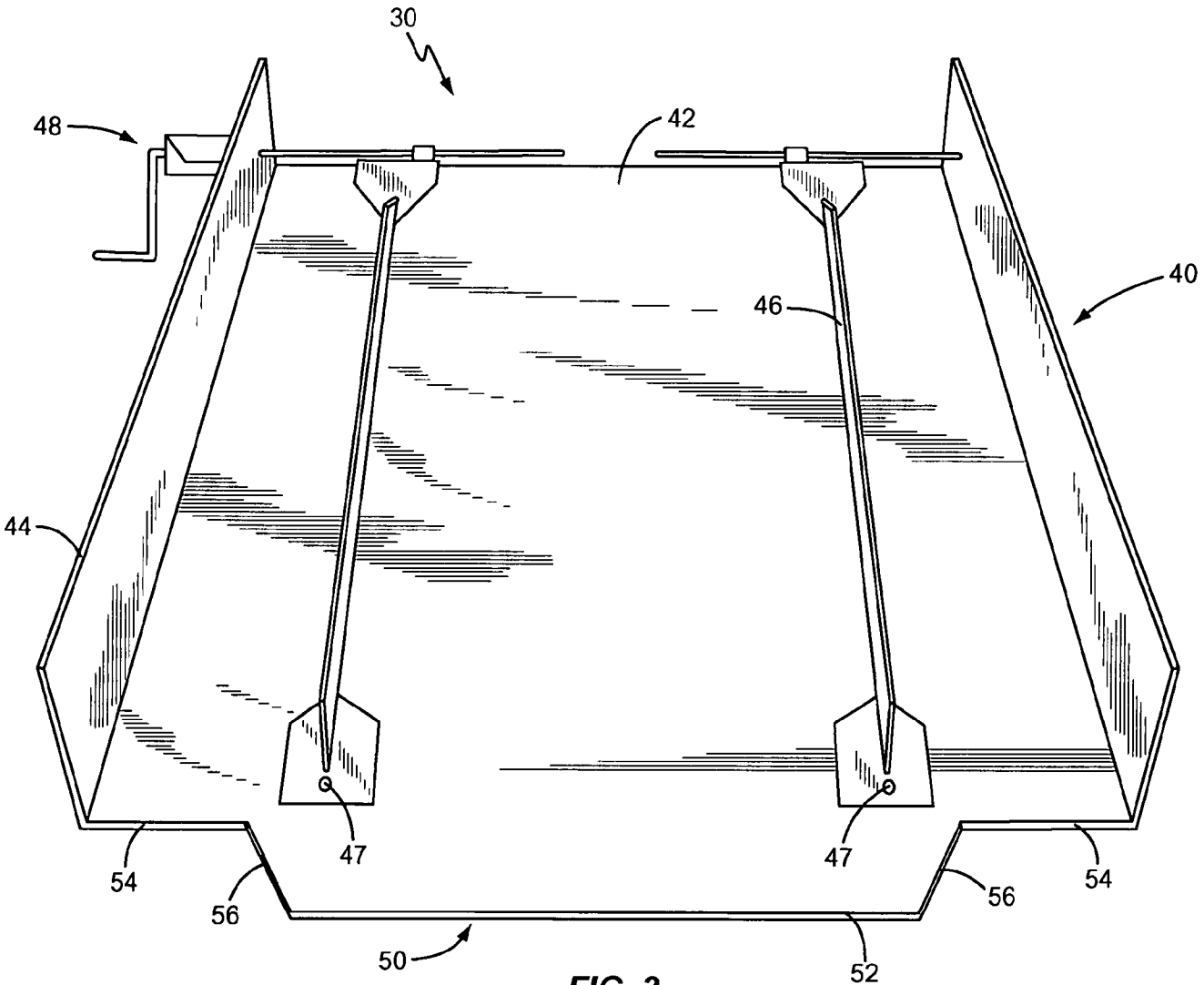
FIG. 3 shows a perspective view of the baseplate assembly of the embodiment of FIG. 2.
Figure 4:
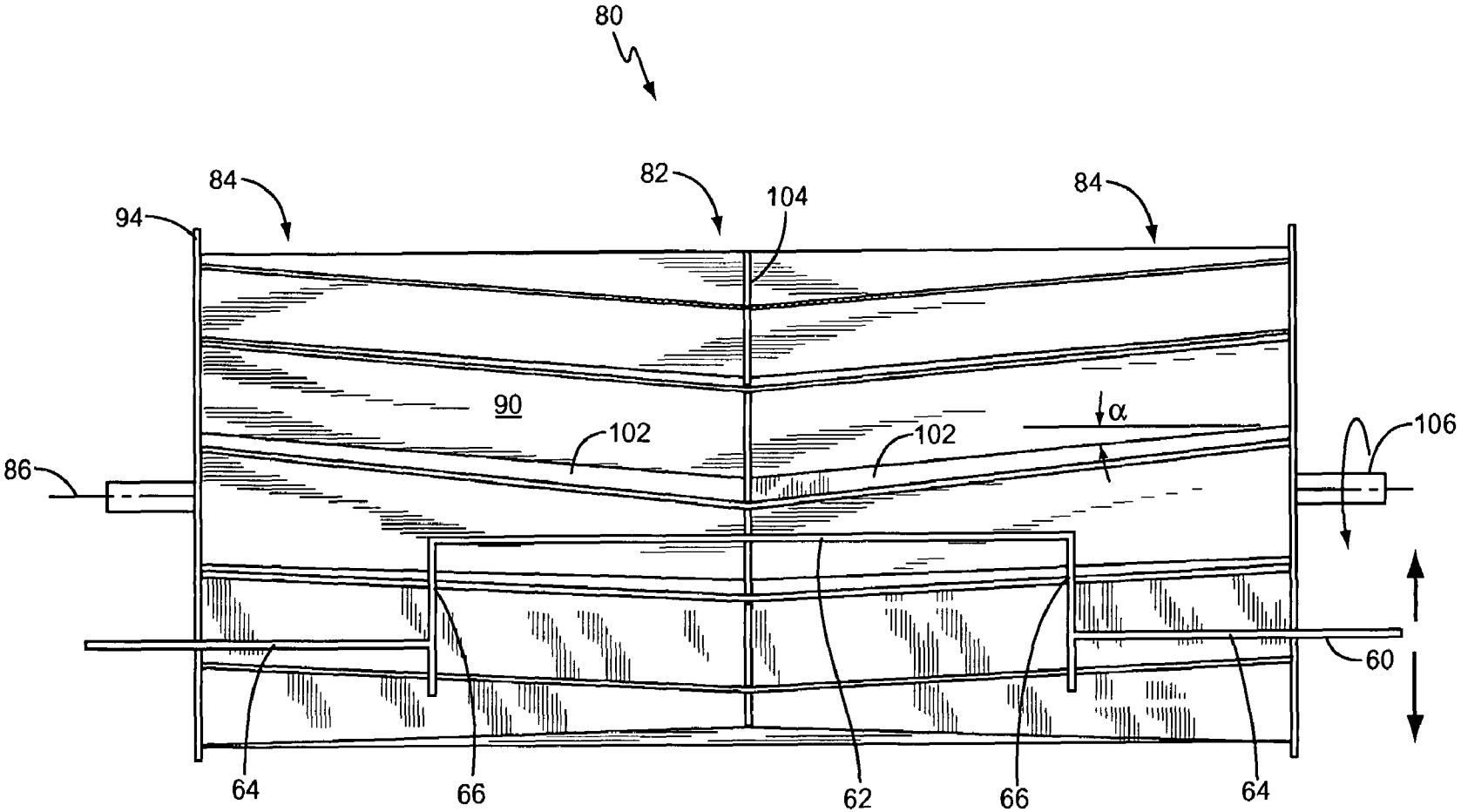
FIG. 4 shows a simplified top view of the drum and deadwall of one embodiment.

Disposed above the drum 80, and between the drum 80 and the conveyor system 14, is a feed chute assembly 30. Referring to FIGS. 3-4, the feed chute assembly 30 includes a sloped baseplate assembly 40 and an optional deadwall 60 towards the output end 50 thereof. The baseplate assembly 40 of a preferred embodiment includes a baseplate 42 and dividers 46. The baseplate 42 is a sturdy, substantially rectangular plate with side flanges 44. The baseplate 42 is disposed in a tilted orientation, so that the input end is higher than the output end 50. The output end 50 preferably has a stepped profile, with a center section 52 flanked by respective side sections 54, and corresponding transition sections 56. The center and side sections 52,54 are preferably straight and parallel to one another, with the center section 52 ending later than the side sections 54. The transition sections 56 provide a transition between the center section 52 and the side sections 54. In a preferred embodiment, the overall appearance of the output end 50 of the baseplate 42 is that of a trapezoid tongue as shown in FIG. 4, but this is not required.

Two dividers 46 may be moveably attached to the baseplate 42 so as to be selectively positioned by pivoting about corresponding pivot points 47 (e.g., shouldered bolts extending through the baseplate 42). The location of the upper ends of the dividers 46 may be adjusted with respect to the baseplate 42 using a suitable adjusting mechanism 48. By way of non-limiting example, the adjusting mechanism 48 may take the form of a crank and threaded rod arrangement, with suitable pivoting connections between the tops of the dividers 46 and the threaded rods. Of course, other means known in the art may be used to control the position of the upper ends of the dividers 46. Whatever means is selected, it will be advantageous to position the controls thereof (e.g., the crank) so as to allow easy access thereto by a user during operation of the handling device 20. The purpose of the dividers 46 is to control the flow ratio of the wood chips flowing down the baseplate assembly 40 to the center 82 and side portions 84 of drum 80.

The deadwall, or directing wall, 60 is a generally vertical wall that acts to focus the flow of the wood chips flowing down the baseplate assembly 40 generally vertically onto the drum 80. As shown in FIG. 4, the deadwall 60 may include a center section 62, flanking side sections 64, and appropriate offset sections 66 therebetween. The center and side sections 62,64 are preferably straight and parallel to one another, and preferably are disposed a height from the center of drum 80. The offset sections 66 are preferably generally perpendicular to the center and side sections 62,64 and are likewise disposed at a height from drum 80. Thus, the deadwall 60, when viewed from above, preferably has the shape shown in FIG. 4. It should be noted that the offset sections 66 may simply connect the center and side sections 62,64; or, alternatively, the offset sections 66 may be longer such that they extend toward the feed chute baseplate assembly 40 to a point beyond the intersection with the side sections 64 as shown in FIG. 4. This optional "extra" length for the offset sections 66 is believed to aid in achieving the desired side-to-side balance of wood chips being supplied to the drum 80. Further, the deadwall 60 should be located, and be of sufficient height, so that the wood chips from the baseplate 42 impact in the vertical middle of the deadwall 60. The bottom of the deadwall 60 should be relatively close to the drum 80, with a clearance therebetween of ½ to three inches believed advantageous when the baseplate assembly 40 is disposed on the drum's rotationally downstream side of the deadwall 60. In addition, the side profile of the bottom of the deadwall 60 may be angled or curved to follow the contour of the drum 80 if desired.

The deadwall 60 is located forward of the output end 50 of the baseplate assembly 40, so that a substantial gap is formed therebetween to allow passage of the wood chips without jamming as the wood chips change flow direction. Further, while the deadwall 60 may be located prior to top dead center (behind the rotation axis 86 of the drum 80), the deadwall is advantageously located at a position that is beyond top dead center of the drum 80 (see FIGS. 2 and 4). The center section 62 of the deadwall 60 may be narrower than the center section 52 of baseplate 42 by about an inch, with the transition sections 56 of the baseplate 42 extending laterally approximately another two inches. Of course, the gap size is at least partially governed by the spacing between the output end of the baseplate assembly 40 and the location of the deadwall 60. The position of the deadwall 60 relative to the baseplate 42 and/or drum 80 may be permanently fixed; however, the position of the deadwall 60 may be adjustable (for instance, ±3 inches) in some embodiments of the present invention, such as by mounting the deadwall 60 using bolts, with multiple bolt holes provided in the frame 22. It may be advantageous to vary the gap size, nominally ten to twelve inches, in proportion to the desired output rate of the device 20.

While the space above the baseplate 42 of the feed chute assembly 30 may be open, the feed chute assembly 30 may optionally include a cover (not shown) spaced from the baseplate 42 to help contain any errant wood chips. The optional cover may extend above the top of the deadwall 60, and be spaced therefrom, so as to provide an overflow route, if desired.

Figure 5:
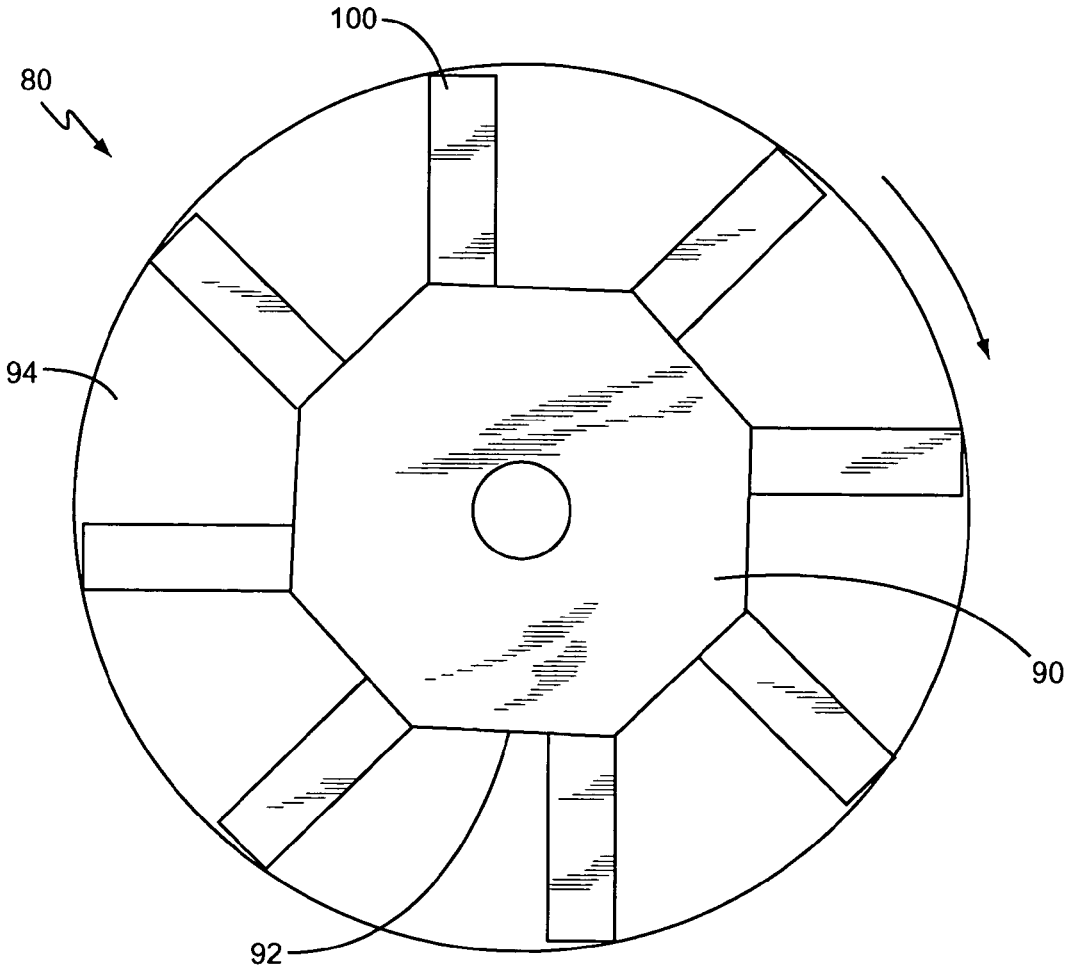
FIG. 5 shows a side view of the drum of FIG. 4 with the near endcap removed.

The drum 80 is mounted for rotation about a generally horizontal axis 86, and supported by the frame 22. The drum 80 may be mounted to an axle 106, which may be a central shaft or a pair of stub shafts, which is in turn supported by suitable bearings mounted to the frame 22. As indicated above, the axle 106 should have a pulley, gear, or like means for accepting non-gravitational rotational power to turn the drum 80, such as from motor 24. The drum 80 includes a main body core 90 with a plurality of outwardly extending blades 100, and preferably a pair of lateral endcaps 94. The main body 90 of the drum 80 may have a circular cross-section, but preferably has a faceted cross-section, such as an octagonal cross-section as shown in FIG. 5. The blades 100 are mounted to the core 90 so as to extend away from the surface thereof; for instance, the blades 100 may extend generally perpendicular from the corresponding facet 92 forming the perimeter of the drum's core 90. The blades 100 should preferably extend from one lateral endcap 94 to the other. Each blade 100 may be a single straight piece, disposed generally parallel to the axis of rotation 86; alternatively, each blade 100 may advantageously include at least two sections 102 that angled with respect to one another, such as by an angle that is twice angle α. For instance, as shown in FIG. 4, each blade 100 may have left and right portions 102 that meet in the center of the core 90 and are angled with respect to one another such that angle α is 1°-45°, preferably about 2°-30, and more preferably about 3°-10°. When this arrangement is viewed from above (see FIG. 4), each facet 92 of the drum's core 90 appears to have a chevron shaped blade 100 thereon; this chevron may point counter to the direction of rotation, but advantageously points in the direction of rotation. Each blade 100 may have an approximately uniform height across its width, and the blades 100 are preferably substantially identical, but neither aspect is strictly required for all embodiments. A reinforcing gusset 104 may extend circumferentially from one blade 100 to the next blade 100.

When the entire leading surface of the blades 100 are disposed so as to be generally normal to the peripheral surface of the core 90 of drum 80 as shown in FIG. 4, the output stream of wood chips flung from the drum is believed to be limited to an angular arc of substantially less than 90°, typically on the order of 60°. That is, when viewed from the side at a position along the axis 86, the output of wood chips from the drum 80 with such blades 100 falls within an arc, centered on the axis 86, of substantially less than 90°. The inventor has recently discovered that alternative configurations of the blades 100 may provide a wider angle of output, thereby allowing for a more efficient process of handling the wood chips.

Figure 6:
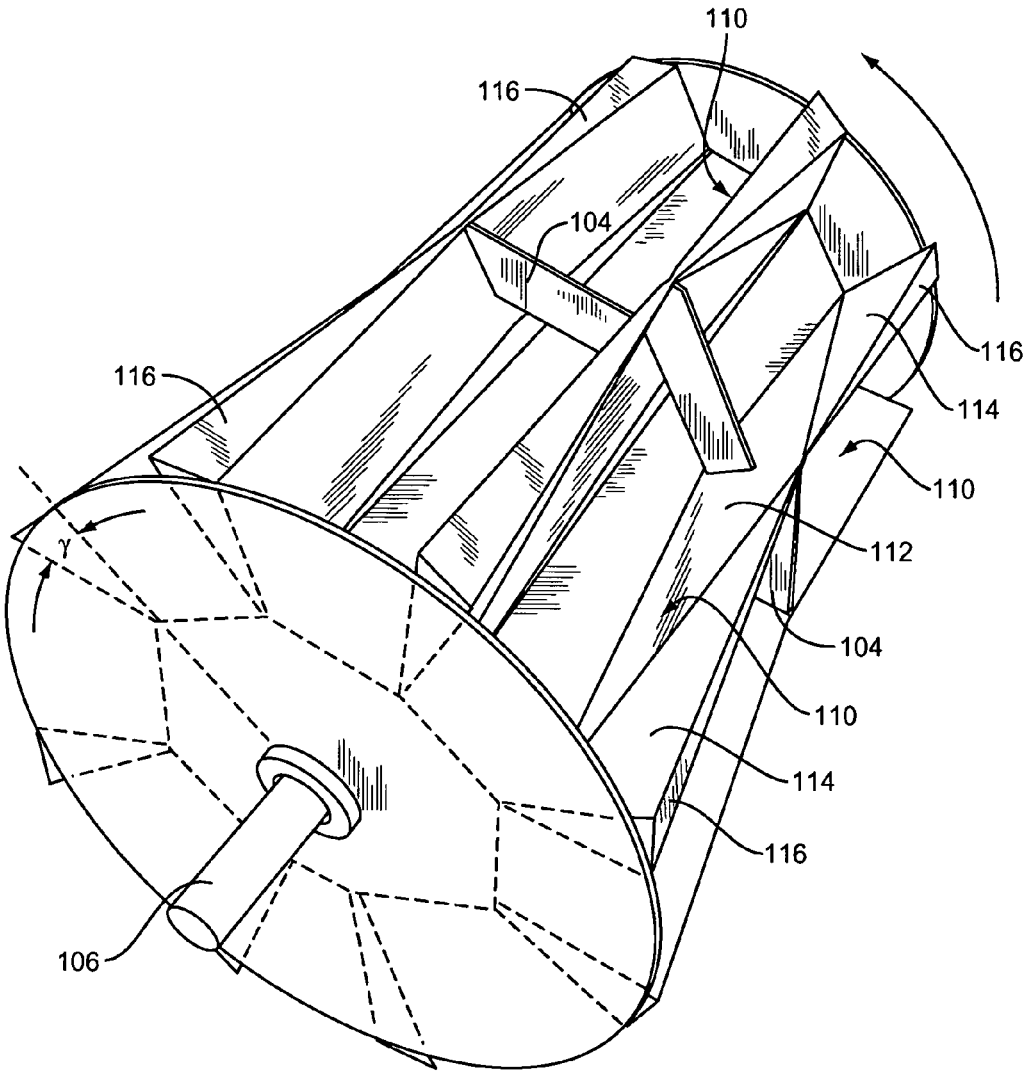
FIG. 6 shows a simplified perspective view of a drum of another embodiment where the drum has flinging blades of an alternative design.

Referring to FIG. 6, the alternate blade design divides the leading or front surface 110 of the blades 100 into at least two sections, so that a portion of the blade is angled forward (in the direction of rotation of the drum 80) relative to another portion of the blade. In one simple embodiment, each lateral half of the forward face 110 of the blade 100 is divided into a base section 112 and a canted section 114 that is angled relative to the base section. The base section 112 connects to the periphery 92 of the core 90 of the drum 80 and extends outward generally normal thereto. The canted section 114 is angled forward (in the direction of rotation) with respect to the base section 112. Both the base section 112 and the canted section 114 may be generally planar, although this is not required in all embodiments. The base section 112 and canted section 114 may be formed by simply bending a single integral blade plate in the appropriate fashion. Alternatively, the canted section 114 may be a separate plate welded or otherwise connected to base section 112. The canted sections 114 may be disposed in a plane generally parallel to axis 86 or may advantageously be skewed with respect to axis 86. For instance, the canted sections 114 has a generally triangular appearance when viewed face on (e.g., forming a point at gusset 104 and at least the full height of the blade 100 at the endcaps 94). For embodiments with a triangular shape to the cant section 114, the relevant cant angle λ may be defined as the angular separation, at the plane of endcap 94, between a theoretical radial line running through the intersection of the canted section 114 and the base section 112, and the plane of the cant section 114. This cant angle λ is typically in the range of 25° to 45°, and advantageously on the order of 35°.

Like the blade configuration shown in FIG. 4, the base section 112 of the modified blade configuration of FIG. 6 may be disposed in a chevron arrangement. With such an arrangement, the tops of canted section 114 may be disposed generally parallel to axis 86, although this is not required in all embodiments.

It may be advantageous to add a planar or convexly curved filler cap 116 to close off any gap between the canted sections 114 and a corresponding hidden extension, if any, of the corresponding base section 112 (not forming a portion of the front face due to the presence of the canted section 114). These filler caps 116 may serve the dual function of preventing wood chips from being accidentally trapped in the drum 80 and reinforcing the upper portion of the canted section 114. Further, to aid in proper chip flow, the height of the canted sections 114 should be higher than that of the flange 94, such as by approximately 1½ inches, and the filler caps 116 should be downwardly angled, such as by 30°-60°. Of course, the canted sections 114 may alternatively extend to a greater or lesser extent.

Thus, the canted sections 114 form a significant portion of the total surface area of the forward face 110 of the blades, typically on the order of 50% of the surface area, although other proportions (e.g., 20%-80%, such as 25%, 33%, 66%, 75%) are within the scope of the present invention. Further, it should be noted that each blade 100 may or may not have canted sections 114. Thus, while it is believed to be advantageous to have substantially identical blades 100, such is not required for all embodiments.

With the addition of the canted sections 114 to the blades 100, the angular arc β of the output pattern may be increased to be more than 90°, and optionally up to approximately 180°. It is believed that increasing the distance of the canted sections 114 from the axis 86, increasing the cant angle λ, and increasing angle α should all increase the angular arc β of the output pattern. In response to the increased angular arc β of the output pattern, it may be advantageous to add suitable deflectors internal to the device 20 so as to reduce scatter and constrain the output, for instance to an arc β of generally 120°. For instance, a simple vertical deflector wall may be added on the downstream side of the device 20 (from the perspective of the rotational direction of the drum 80) that extends down to about the lowest level of the drum, and an simple 45° deflector wall (generally parallel to the feed chute 30) may be added to the upstream side of the device 20.

While the discussion above has been in terms of the blade's forward face 110 being divided into two sections 112,114, it should be understood that the blade's forward face 110 may be divided into more than two sections, some of which may be canted forward (possibly at various angles) and others of which may not, and such configurations are intended to be within the scope of the present invention. Further, it should be noted that, within the context of the present invention, a blade 100 with forward face 110 having a curving profile is considered to have at least two sections, at least one of which is angled with respect to another, regardless of whether or not the curve profile has a uniform radius of curvature.

One example of the handling device 20 of the present invention may be made using a drum 80 with a diameter of approximately thirty inches, approximately 48 inches in width, and an octagonal cross-section of approximately seven inch wide facets 92. The blades 100 may be approximately six inches in height, with two sections of approximately 24-⅛ inches meeting at an angle α of approximately 8°, and spaced at intervals of approximately seven inches. The generally planar base sections 112 are formed from the main material of the blade 100, and generally planar canted sections are welded thereto so that the height of the canted section 114 is seven and one-half inches at the endcaps 94 and tapers across the approximately twenty-four inch length of the blade section 102 to almost zero at the middle of drum 80. The gussets 104 may be approximately three inches in height. The baseplate 42 of the feed chute assembly 30 may be at a 45° angle, with the 24-30 inch high deadwall 60 positioned such that the center section 62 is approximately five inches after top dead center and the side sections 64 are approximately ten inches after top dead center, for a gap between the deadwall 60 and the baseplate 42 of approximately ten to twelve inches. The extra length for the offset sections 66 may be two inches. The vertical gap between the drum and the deadwall may be ½ to three inches, with a smaller gap believed to be more advantageous. The pivoting divider walls 46 may be made adjustable, with a target distribution of 25%-50%-25% for feeding to the left 84, center 82, and right 84 portions of the drum 80 respectively. The deadwall 60 and feed chute assembly 30 may be formed of ¼ inch stainless steel, with the other portions of the device 20 contacting the wood chips may advantageously made from ¼ inch abrasion resistant (AR) steel, although other materials known in the art may serve equally well. The velocity of the drum 80 at the periphery thereof may, for example, be on the order of 2500-3000 ft/min.

It should be noted that in order to minimize the escape of errant wood chips during loading, the frame 22 may advantageously include additional scatter shields at appropriate locations. The shield locations generally include on either side of the feed chute assembly 30, and slightly downstream from the drum 80, but these locations may vary depending on the details of a particular installation site.

The handling device 20 may be used to load wood chips, and particularly uniformly-sized paper making wood chips, into a pile, either on the ground or in a suitable container. Representative examples of suitable containers include railcars 12, ships, barges, trailers, storage bins, and process containers such as digestion chambers. Using a railcar 12 as an illustrative example of a container, the device 20 is mounted to the tower 16 of the loading station 10. The railcar 12 is positioned below the handling device 20, and motor 24 is started to start the drum 80 rotating. Before feeding wood chips to the device 20, the drum 80 should be rotating at a rate of at least approximately 50 rpm, more particularly at least about 200 rpm, and more particularly at approximately 300 rpm. When the drum 80 is spinning properly, wood chips are supplied to the feed chute assembly 30 by the conveyor system 14, falling as an input stream 200 to the drum 80. The wood chips fall to the drum 80 and are then flung by the blades 100 of the spinning drum 80. The output stream of wood chips leaving the drum 80, when the drum 80 has the blades 100 with canted portions as described above, flows both forward and rearward from the drum 80. Indeed, the output stream covers an arc β of typically 90°-120°, centered about the axis 86 of the drum 80. When viewed from above, the output pattern of the wood chips advantageously has a generally rectangular shape, with perhaps a slight narrowing towards the middle. The wood chips flung from the drum 80 are captured by, and form a pile in, the container 12.

Even with a generally rectangular output pattern, there may be an undesirable side-to-side distribution of the wood chips within the output pattern. For instance, the distribution of wood chips in the output pattern to the middle subsector, right side subsector, and left side subsector may be uneven and/or otherwise undesirable for some reason (e.g., output shifted left of center, leaving right side subsector relatively unfilled). If the optional variably positioned dividers 46 are employed, then the ratio of output flow to the various subsectors may be adjusted by the operator during operation (via adjusting mechanism 48) to reach the desired ratios. Of course, adjustments can also be made to the drum 80 rotational speed and to the wood chip supply rate from the conveyor system 14.

While the exact principles are not fully understood, the handling device 20 of the present invention is able to pack wood chips at density substantially higher than so-called free-fall loading. In free-fall loading, the wood chips from the conveyor system 14 are directed to a pile, in a container or otherwise, via a simple chute system. Examination of free-fall loaded wood chips "packed" in the pile show that they land with widely varying orientations, sometimes referred to as "jack strawed" (like unstacked firewood), resulting in non-optimum density. In contrast, the wood chips loaded via the present device 20 land with a substantially consistent orientation, resulting in increased density.

The actual packed density achieved is expected to vary depending on variations in size and moisture content of the wood chips, and possibly on rotational speed of the drum 80. However, a simple ratio, referred to herein as the packing density factor, can be used to quantify the improvement provided by the present invention. The packing density factor is simply the ratio of the weight of wood chips in a given volume when packed with the test device 20 divided by to the weight of the same volume of the same type wood chips (i.e., same size and moisture content), packed using the free-fall method. For instance, it is expected that a common 7100 $ft^3$ railcar loaded with wood chips using the free fall method will have approximately seventy-seven tons of wood chips. It is expected that if the same type wood chips are loaded using the device 20 of the present invention, the 7100 $ft^3$ railcar could hold approximately one hundred tons of wood chips. Using these values, the packing density factor for the present invention would be 100/77=1.30. Clearly, substantial improvements in packing may be achieved using the present device 20, with resulting packing density factors in the range of 1.20 to 1.35 or higher. For reference, these type of packing density factors typically correspond to densities of 26.0 pounds/$ft^3$ to 29.3 pounds/$ft^3$ or more.

It should also be noted that most prior art devices which rely on a distribution device that spins about a generally vertical axis (e.g., of the type shown in U.S. Patent Publication Ser. No. 2002/0076308) tend to create round output patterns covering substantially a full 360°, which are ill suited to filling rectangular containers. As the majority of wood chips shipped between domestic locations are shipped by rail, using rectangular railcars 12, the preferred embodiments of the present invention are more suited to the needs of the industry.

The densely packed output from the flinger 20 is useful in densely packing wood chips in a variety of containers, and even for stacking wood chips on the ground. For example, many wood pulp mills receive wood chips generated at other locations and then store the wood chips as inventory for subsequently making wood pulp. It is common for this "inventory" of wood chips to be stored in a pile on the ground, such as on rough cleared land or on a concrete pad. In the prior art, this inventory pile is typically formed by the wood chips falling off the distal moving end of an inclined boom, with the wood chips routed thereto by a conveyor that runs along the boom. The booms may be track-guided linear motion booms, or may be rotating type booms. In the former case, the resulting pile of wood chips is typically an elongated mound; in the later case, the resulting pile of wood chips has an arc or annular shape when viewed from above, as dictated by the rotating boom. In both cases, the resulting pile is rather loosely packed, as it is formed by a free-fall process, with densities generally in the range of 19-23 pounds/ft$^3$. The flinger 20 of the present invention may be used in such situations to allow more chips to be stored in the same space, by packing the chips with significantly higher density compared to the conventional free-fall technique, typically on the order of 25-30 pounds/ft$^3$. Thus, the pile may be said to have a packing density factor of 1.20 or more, and preferably a packing density factor of 1.3 or more.

The dense packing advantage of the flinger 20 may also be used to improve the efficiency of various processes that use wood chips. For instance, the "digesting" process well known in the wood pulp industry uses wood chips loaded into a digestion chamber with various chemicals to generate wood pulp with the general consistency of mashed potatoes. The digestion chamber is operated in a batch mode, with the wood chips and chemicals added, the digestion chamber (container) closed, and heat, high pressure steam, or the like, added for a specified period of time, and then the digestion chamber is unloaded and the process repeated on a new batch. The conventional technique for loading wood chips into the digestion chamber is to have the wood chips free-fall from a conveyor into an opening in the top of the container. Instead, according to the present invention, the flinger 20 may be interposed between a conveyor system 14 and the opening. The input stream of wood chips is fed to the rotating drum 80 of the flinger 20 so that the wood chips are redirected and flung into the digestion chamber with a preferential orientation so as to be packed therein more densely. The wood chips packed in the digestion chamber using the present technique may have a packing density factor of 1.20 or more, and preferably a packing density factor of 1.3 or more. The usual digesting chemicals may be added before, during, or after the wood chip loading, with the amounts thereof adjusted to accommodate the increased weight quantity of wood chips present in a batch. The process may then continue as in the conventional digesting technique. By using the flinger 20 to aid in densely packing the wood chips in the digestion chamber, more wood chips may be processed by a given piece of equipment in a given time period, resulting in a more cost effective process.

The discussion above has described a device 20 using a single rotating drum 80. In most applications, this will be sufficient. However, the present invention is not limited thereto, and devices 20 employing a plurality of drums 80 rotating about one or more generally horizontal axes 86 are intended to be encompassed by the present invention. The most likely arrangement for such a multiple drum 80 arrangement would be to have the drums 80 located coaxially, in a manner easily understood by one of ordinary skill in the art based on the teachings of the present application.

The increase in packing density readily achieved by the present invention has clear benefits to the industry. In the simplest terms, more wood chips can be packed into a smaller space, thereby lowering transportation, storage, and processing costs. Further, given the substantial increase in packing density achieved, the cost savings can be considerable.

Under some circumstances, the additional packing density provided by use of the present flinger 20 may cause certain containers to be become overweight and/or unbalanced. For instance, railcars 12 packed using the flinger device 20 may be loaded with wood chips to a weight that is more than allowed. As such, the inventor has developed a method of filling containers, such as railcars 12, using the flinger device 20 that allows for tighter control of the filling process to avoid overfilling and/or undesirable unbalanced loading. In the method, the filling results of the preceding container (s) are used as inputs to a feedback control loop to control the filling of the current container. The current container is initially filled to a predetermined point with "dense-pack" material using the flinger 20 as described above. The predetermined point may be a certain amount of loading time, or a certain weight of material, or to a certain height within the container. The container is then further filled to the desired volume level by filling with "loose-pack" material. The "loose-pack" material may be loaded into the container by simply turning off the rotational power to the drum 80, resulting a modified form of free-fall output of material; alternatively the "loose-pack" material may be output from a different leg of a "pants leg" chute system (one that does not have a flinger 20). The current container is then subjected to evaluation (e.g., weight measurement) to determine the loading conditions for the next container. In this fashion, the ratio of "dense-pack" to "loose-pack" materials may be adjusted from container to container to assure that the containers are not over-weighted.

In addition to problems with too much weight overall, the containers filled using a flinger 20 may be subjected to uneven loading. For instance, if the front portion of a railcar 12 is filled with "dense-pack" material using the flinger 20, but the desired total amount of "dense-pack" material is reached before the back portion of the railcar 12 is substantially loaded, and the remainder of the railcar 12 is filled with "loose-pack" material, then the front portion of the railcar 12 will be heavier than the back portion of the railcar 12. Thus, while the overall weight of the railcar 12 may be acceptable, the front wheel carriage of the railcar 12 may be carrying more than ½ of the acceptable weight. As most railroads do not allow the respective front and rear wheel carriages to carry more than ½ of the maximum allowed weight per railcar 12, such a loading condition would be undesirable. In order to combat this, the height, and thus the volume, of the fill for the "dense-pack" material may be set at a certain uniform level for a railcar 12 and monitored with suitable monitors (e.g., optical sensors, scales for railcar, belt scales on the conveyor 14, etc.). This level, referred to as a packing depth, could be adjusted from railcar to railcar based on the actual measured weight for the preceding railcar. For example, if railcars are filled to the packing depth with "dense-pack material" and then filled to the volume limit with "loose-pack" material, all railcars would appear to be full. If the overall weight of railcar N-1 measured after filling is less than the upper weight limit, then the packing depth of railcar N could be raised the appropriate amount. Conversely, if the overall weight of railcar N-1 is more than the upper weight limit (perhaps minus some guard band amount), then the packing depth of railcar N could be lowered the appropriate amount. Thus, the ratio of "dense-pack" material to "loose-pack" material could be adjusted to get the maximum weight of material in each railcar 12 while having all railcars appear to be full to the naked eye. Of course, the feedback control loop of such a process may consider more than the immediately preceding railcar (e.g., a running average of the preceding three railcars), and suitable default starting values could be established, depending on the level of sophistication desired. Further, one of ordinary skill in the art will recognize that other containers could also be filled using this technique, with barges being another likely application of the technique.

As will be understood by one of ordinary skill in the art, the filling process may be manually controlled by an operator as described above. Alternatively, as suitable electronic controller, such as a programmable logic unit (not shown) programmed with a control program as outlined above, may be employed. Such an electronic controller should advantageously be connected to the corresponding sensors, etc.

While the invention has been illustrated and described in detail in the drawings and foregoing description, the same is to be considered as illustrative and not restrictive in character, it being understood that only some embodiments have been shown and described and that all changes and modifications that come within the meaning and equivalency range of the appended claims are intended to be embraced therein.

What is claimed is:

1. An assembly for processing wood chips, comprising:

a drum disposed so as to rotate about a generally horizontal axis and spinning at a rate of about 50 rpm or more, said drum including a plurality of outwardly extending blades; wherein said blades comprise a leading face with at least a first face section that extends in a first direction and at least a second face section extending at a forward angle relative to said first section; and wherein output from said drum, when an input stream of wood chips is fed to said drum, covers an arc of at least 90° when viewed from a position along said horizontal axis spaced from said drum;

a feed chute disposed upstream from said drum and supplying said input stream of wood chips to said drum; wherein said feed chute comprises a baseplate and a plurality of divider walls moveably mounted to said baseplate, wherein said divider walls control the relative flow ratios of said input stream to a first side portion, a center portion, and a second side portion of said drum.

2. The assembly of claim 1 wherein said drum spins at 150 rpm or more.

3. The assembly of claim 1 wherein said arc is generally downwardly facing.

4. The assembly of claim 1 wherein said drum has a core surface with a non-circular cross-section.

5. The assembly of claim 1 further comprising a motor operatively connected to said drum and supplying rotational power thereto.

6. The assembly of claim 1 further comprising a motor operatively connected to said drum and supplying rotational power thereto; wherein said drum spins at 150 rpm or more.

7. The assembly of claim 1 wherein said first face section is disposed closer to said axis than said second face section.

8. An assembly for processing wood chips, comprising:

a drum disposed so as to rotate about a generally horizontal axis and spinning at a rate of about 50 rpm or more, said drum including a plurality of outwardly extending blades, wherein said blades comprise a leading face with at least a first face section that extends in a first direction and at least a second face section extending at a forward angle relative to said first section;

wherein an output stream of wood chips from said drum covers an arc of more than 90° when viewed from a position along said horizontal axis spaced from said drum when an input stream of wood chips is fed to said drum; and said output stream causing a pile of wood chips to be formed a packing density factor of at least 1.20;

a feed chute disposed upstream from said drum and supplying said input stream of wood chips to said drum; wherein said feed chute comprises a baseplate and a plurality of divider walls moveably mounted to said baseplate, wherein said divider walls control the relative flow ratios of said input stream to a first side portion, a center portion, and a second side portion of said drum.

9. The assembly of claim 8 wherein said drum spins at 150 rpm or more.

10. The assembly of claim 8 wherein said arc is generally downwardly facing.

11. The assembly of claim 8 further comprising a motor operatively connected to said drum and supplying rotational power thereto.

12. The assembly of claim 8 further comprising a container for receiving said output.

13. The assembly of claim 8 wherein said packing density factor is at least 1.25.

14. The assembly of claim 8 further comprising a motor operatively connected to said drum and supplying rotational power thereto; wherein said drum spins at 150 rpm or more.

15. An assembly for processing wood chips, comprising:

a drum disposed so as to rotate about a generally horizontal axis and spinning at a rate of about 50 rpm or more, said drum including a plurality of outwardly extending blades; and said blades comprising a leading face with at least a first face section that extends in a first direction and at least a second face section extending at a forward angle relative to said first section;

a feed chute disposed upstream from said drum and supplying said input stream of wood chips to said drum; wherein said feed chute comprises a baseplate and a plurality of divider walls moveably mounted to said baseplate, wherein said divider walls control the relative flow ratios of said input stream to a first side portion, a center portion, and a second side portion of said drum.

16. The assembly of claim 15 wherein said first and second face sections are generally planar.

17. The assembly of claim 15 wherein said first section extends outwardly away from a core of said drum.

18. The assembly of claim 15 wherein said first direction is generally radial with respect to said axis.

19. The assembly of claim 15 wherein said drum spins at 150 rpm or more.

20. The assembly of claim 15 further comprising a container for receiving said output.

21. The assembly of claim 20 wherein said container is selected from the group consisting of a train car, a ship, a barge, a trailer, a storage bin, and a digestion chamber.

22. The assembly of claim 15 wherein said forward angle is in the range of 25° to 45°.

23. An assembly for processing wood chips, comprising:

a drum disposed so as to rotate about a generally horizontal axis and spinning at a rate of about 50 rpm or more, said drum including a plurality of outwardly extending blades;

wherein output from said drum, when an input stream of wood chips is fed to said drum, covers an arc of at least 90° when viewed from a position along said horizontal axis spaced from said drum; and a feed chute disposed upstream from said drum and supplying said input stream of wood chips to said drum, wherein said feed chute comprises a baseplate and a plurality of divider walls moveably mounted to said baseplate, wherein said divider walls control the relative flow ratios of said input stream to a first side portion, a center portion, and a second side portion of said drum.

24. The assembly of claim 23 wherein said drum spins at 150 rpm or more.

25. The assembly of claim 23 wherein said blades comprise a leading face with at least first and second face sections extending in different directions.

26. The assembly of claim 23 wherein said arc is generally downwardly facing.

27. The assembly of claim 23 wherein said drum has a core surface with a non-circular cross-section; said blades mounted to said core surface.

28. The assembly of claim 23 further comprising a motor operatively connected to said drum and supplying rotational power thereto.

29. The assembly of claim 23 further comprising a container for receiving said output.

30. The assembly of claim 23 further comprising a motor operatively connected to said drum and supplying rotational power thereto, wherein:

said blades comprise a leading face with at least first and second face sections extending in different directions; and said drum spins at 150 rpm or more.

31. An assembly for processing wood chips, comprising:

a drum disposed so as to rotate about a generally horizontal axis and spinning at a rate of about 50 rpm or more, said drum including a plurality of outwardly extending blades;

wherein an output stream of wood chips from said drum covers an arc of more than 90° when viewed from a position along said horizontal axis spaced from said drum when an input stream of wood chips is fed to said drum; and a feed chute disposed upstream from said drum and supplying said input stream of wood chips to said drum, wherein said feed chute comprises a baseplate and a plurality of divider walls moveably mounted to said baseplate, wherein said divider walls control the relative flow ratios of said input stream to a first side portion, a center portion, and a second side portion of said drum;

said output stream causing a pile of wood chips to be formed with a packing density factor of at least 1.20.

32. The assembly of claim 31 wherein said drum spins at 150 rpm or more.

33. The assembly of claim 31 wherein said blades comprise a leading face with at least first and second face sections extending in different directions.

34. The assembly of claim 31 wherein said arc is generally downwardly facing.

35. The assembly of claim 31 further comprising a motor operatively connected to said drum and supplying rotational power thereto.

36. The assembly of claim 31 further comprising a container for receiving said output.

37. The assembly of claim 31 wherein said packing density factor is at least 1.25.

38. The assembly of claim 31 further comprising a motor operatively connected to said drum and supplying rotational power thereto, wherein:

said blades comprise a leading face with at least first and second face sections extending in different directions;

said drum spins at 150 rpm or more.

* * * * *